US006797347B2

(12) United States Patent
Chow

(10) Patent No.: US 6,797,347 B2
(45) Date of Patent: Sep. 28, 2004

(54) PIGMENT TREATMENT IN PAPER COATING COMPOSITIONS FOR IMPROVING INK-JET PRINTING PERFORMANCE

(75) Inventor: Joseph S. Chow, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 15 days.

(21) Appl. No.: 10/236,399

(22) Filed: Sep. 5, 2002

(65) Prior Publication Data

US 2003/0048346 A1 Mar. 13, 2003

Related U.S. Application Data

(62) Division of application No. 08/711,026, filed on Sep. 9, 1996, now Pat. No. 6,505,929.

(51) Int. Cl.[7] ..... B41M 5/40

(52) U.S. Cl. ..... 428/32.36; 428/32.21; 428/32.27; 428/32.3

(58) Field of Search ..... 428/32.27, 32.3, 428/32.21, 32.36

(56) References Cited

U.S. PATENT DOCUMENTS

| | | | | |
|---|---|---|---|---|
| 4,220,601 A | | 9/1980 | Schneider et al. | |
| 4,419,388 A | | 12/1983 | Sugiyama et al. | |
| 4,554,181 A | | 11/1985 | Cousin et al. | |
| 4,694,302 A | | 9/1987 | Hackleman et al. | |
| 4,740,420 A | | 4/1988 | Akutsu et al. | |
| 4,790,880 A | * | 12/1988 | Miller | 106/31.46 |
| 4,830,911 A | | 5/1989 | Kojima et al. | |
| 4,851,316 A | * | 7/1989 | Lu et al. | 430/115 |
| 4,954,395 A | * | 9/1990 | Hasegawa et al. | 428/318.4 |
| 5,206,071 A | | 4/1993 | Atherton et al. | |
| 5,320,668 A | | 6/1994 | Shields et al. | |
| 6,187,523 B1 | * | 2/2001 | Aylward et al. | 430/527 |
| 6,203,899 B1 | * | 3/2001 | Hirose et al. | 428/341 |
| 6,312,100 B1 | * | 11/2001 | Loosli et al. | 347/43 |
| 6,471,766 B2 | * | 10/2002 | Ohki et al. | 106/498 |
| 6,505,929 B1 | * | 1/2003 | Chow | 347/105 |
| 6,521,323 B1 | * | 2/2003 | Sakaki et al. | 428/195 |
| 2002/0136780 A1 | * | 9/2002 | Bataresh | 424/618 |

FOREIGN PATENT DOCUMENTS

| | | | | |
|---|---|---|---|---|
| EP | 0504825 B1 | | 7/1995 | |
| EP | 0 827 842 A1 | * | 3/1998 | B41M/5/00 |
| EP | 1 034 940 A1 | * | 9/2000 | B41M/5/00 |

* cited by examiner

*Primary Examiner*—B. Shewareged

(57) ABSTRACT

Paper coating compositions are provided for use with thermal ink-jet color printers, such as Hewlett-Packard Company's DeskJet® printer. The organic pigment present in the paper is modified by the addition of a metal-charge complex which causes anionic colorants in the ink to be precipitated on the surface of the paper. Printing any of the ink-jet ink sets onto the specially-prepared paper improves resolution, color retention, waterfastness, smear-fastness, image retention and image density while decreasing image bleed in ink-jet printing.

14 Claims, No Drawings

PIGMENT TREATMENT IN PAPER COATING COMPOSITIONS FOR IMPROVING INK-JET PRINTING PERFORMANCE

CROSS REFERENCE TO RELATED APPLICATION(S)

This is a divisional of application No. 08/711,026 filed on Sep. 9, 1996, now patented as U.S. Pat. No. 6,505,929, which is hereby incorporated by reference herein.

TECHNICAL FIELD

The present invention relates to a method of ink-jet printing, and more particularly, to printing ink-jet inks onto a print medium where a coating on the medium contains an inorganic pigment that has been modified to have a positive charge.

BACKGROUND ART

Thermal ink-jet printers offer a low cost, high quality, and comparatively noise-free option to other types of printers commonly used with computers. Such printers employ a resistor element in a chamber provided with an egress for ink to enter from a plenum. The plenum connects to an ink storage reservoir. The arrangement of a plurality of such resistor elements forms a particular pattern, called a primitive, in a printhead. Each resistor element is associated with a nozzle in a nozzle plate, through which ink is expelled toward a print medium. The entire assembly of printhead and reservoir comprise an ink-jet pen.

In operation, each resistor element is connected via a conductive trace to a microprocessor, where current-carrying signals cause one or more selected elements to heat. The heating creates a bubble of ink in the chamber, which jets through the nozzle toward the print medium. In this way, firing a plurality of such resistor elements in a particular order in a given primitive forms alphanumeric characters, performs area-fill, and provides other print capabilities on the medium.

Recording media used in ink-jet printing include various papers such as plain papers and coated papers as well as synthetic papers, cloths and plastic films. The recording, or print, medium must absorb ink well and be free from bleed and feathering of the deposited image. The medium must be capable of accepting high resolution (i.e. small) dots with high image density (i.e. relatively large volumes of ink). Lateral diffusion of ink dots should be small. The medium should have high opacity and prevent show through to the non-printed side. The medium should promote the drying of the ink. Other aspects of the medium can affect the water- and light-fastness of the recorded images as well. As ink-jet printers have been designed with the ability to print at higher speeds and to place more precisely the dot of ink on the print medium, the demands on the print medium have increased. No print medium for use in modern ink-jet printers encompasses all the desired features.

Since an ink-jet recording paper was first sought, attempts have been made to satisfy the above-mentioned requirements. With the increased demands placed on the medium by more advanced printer capabilities, the performance of the paper necessary to satisfy the requirements has greatly increased. One method used in the past to satisfy the mentioned requirements provided a substrate with a coating layer (ink receptive layer) comprising a pigment and a binder that absorb ink well. As seen from the following patent citations, one method for improving the imaging output was to immobilize the ink on the paper coating by incorporating a cationic polymer or other additives in the paper coating. Metallic salts were used in the past for the same purpose. However, due to the water sensitivity of the metal salt, print quality varies depending of the printing environment.

U.S. Pat. No. 4,694,302, entitled "Reactive Ink-Jet Printing" and assigned to the same assignee as the present application, discloses a print method for increasing the water-fastness and print quality of an ink. In that invention, a reactive species that chemically links the ink dye to the paper substrate is applied to the print medium either before or after printing the ink.

U.S. Pat. No 4,419,388, entitled "Waterproofing Method for Ink-jet Records," discloses an increase in waterfastness by applying a treatment of various mixed-metal sulfates or selenates to the surface of the paper after the image has been recorded. To improve ink-jet printing, U.S. Pat. No. 4,830,911, entitled "Recording Sheet for Ink-jet Printers," employs a cationic water-soluble polymer coating applied after an aqueous ink has been printed to form the image. The preceding inventions suffer from the complexity of needing either two separate printheads or an additionally coating step after printing to achieve improvements in print quality.

U.S. Pat. No. 5,320,668, entitled "Bleed Alleviation Using pH-sensitive Agents" and assigned to the same assignee as the present application, uses a method of printing where contact with another ink of either higher or lower pH than the first forces the colorant/dispersant of the first ink out of solution. That patent specifically addresses the problem of color migration between inks of different colors and, while the invention effectively alleviates bleed between two ink colors, it cannot be used to improve the print quality when using a single ink.

U.S. Pat. No. 5,206,071, entitled "Archivable Ink-jet Recording Media," uses a water insoluble high molecular weight quaternary ammonium salt to reduce bleed at high humidity. U.S. Pat. No. 4,740,420, entitled "Recording Medium for Ink-Jet Printing," and U.S. Pat. No. 4,554,181, entitled "Inkjet Recording Sheet Having a Bicomponent Cationic Recording Surface," disclose recording media which have been modified by surface treatments containing soluble metal salts to aid in insolubilization of the colorant in the ink. This latter reference suffers from the need for at least one extra step in the manufacturing of the medium to apply the soluble metal salt surface treatment. Also, when soluble salts are used, the print quality varies with humidity due to the interaction between the salts and air-borne water vapor. The references described above suffer from complex and expensive, post-manufacture, surface modification of the print medium or complicated multi-step processes to achieve the needed improvements in print quality. Furthermore, none of these methods simultaneously address all the needs of print media that are to be used with advanced ink-jet printers.

Although the above-described ink-jet printing methods and media treatments are suitable for their intended purposes, a need remains for a method of ink-jet printing that conveniently, economically, and simultaneously improves resolution, color retention, waterfastness, smear-fastness, image retention and image density while decreasing image bleed in ink-jet printing by improving the ink handling capabilities of the recording medium.

DISCLOSURE OF INVENTION

In accordance with the invention, a print method is provided which substantially improves resolution, color retention, waterfastness, smear-fastness, image retention and image density while decreasing image bleed in ink-jet printing by conveniently supplying a cation in the form of a metal-organic charge complex incorporated within the pigment of the print medium itself More specifically, the print method comprises the steps of:

(a) providing an ink-jet ink that contains a colorant that is either anionic or is a pigment, dispersed with an anion-sensitive dispersant;

(b) providing an ink-jet print medium containing:
  (1) a base paper, and
  (2) a coating on the base paper that contains an inorganic pigment, modified with a positively charged complex, and a binder; and (c) printing the ink-jet ink onto the ink-jet print medium, thereby substantially improving resolution, color retention, waterfastness, smear-fastness, image retention and image density while decreasing image bleed between adjacently-printed inks.

The cationic metal-organic charge complex insolubilizes the anionic dyes in the ink-jet inks or destroys the dispersing ability of dispersants in the vehicle when the colorant is pigment-based. It serves to improve the waterfastness of the printed image more than the soluble metal salts used in the prior art. Also, the choice of a metal ion that is only very slightly soluble in water improves the performance of the paper when used in environments with adverse humidity conditions. When paper is used as the print medium in the present invention, no additional steps are required in the paper production process because common commercial paper already contains a manufacturing step where an opaque pigment is added.

BEST MODES FOR CARRYING OUT THE INVENTION

The invention described herein is directed to a coated print medium for use with ink-jet color or black printers, particularly thermal ink-jet printers such as Hewlett-Packard's DeskJet® printers. It enables an ink-jet color printer to produce high-quality images with improved resolution, color retention, waterfastness, smear-fastness, image retention and image density combined with decreased image bleed in ink-jet printing by inducing precipitation of the colorant of the inkjet ink. Specifically, an inorganic layer is applied to the print medium. The inorganic layer contains a metal-organic complex that imparts a cationic charge to the surface of the medium.

In the case of paper, the nature of the applied inorganic layer is a modification of the pigment layer already present on the paper which consists of the addition of a metal-organic complex to the pigment layer. The surface of the medium is then capable of causing the precipitation of the anionic colorant in the ink-jet ink by an electrostatic or ionic interaction between the negatively charged colorant from the ink-jet ink and the positively charged surface. When the colorant is a pigment, the cation treatment of the inorganic pigment layer causes anionically-dispersed colorant pigments to precipitate. For the purpose of this invention, the term "anionically-dispersed" is intended to cover all instances in which a cation can vitiate the dispersing ability of the ink vehicle.

Since the interaction between the metal-organic complex and ink-jet ink colorant occurs on the surface of the medium, the colorant remains substantially on the surface. Due to the choice of metal-organic complex, the colorant becomes part of a water insoluble solid. Since the colorant becomes part of a water-insoluble solid after interaction with the surface of the medium, it creates a permanent image that is substantially smear- and water-fast. Also, since the colorant becomes immobilized on the surface of the print medium, the printed image is substantially free of bleed, while resolution and image density are substantially improved.

The metal-organic complex contains a metal ion and an amino acid and has a simple counterion associated with it. A suitable metal ion must meet the following criteria: (1) it must form a clear or white complex with the organic complexing ligands, (2) it must form an slightly soluble complex with the organic complexing ligands, and (3) it must not affect the color purity of the dyes in the ink-jet inks when the inks are printed. In the practice of this invention, trivalent ions more effectively precipitate anionic dyes than do mono- or di-valent ions, and are thus preferred.

The metal-organic complex comprises certain complexes of amino acids or other chelates and polyvalent metal compounds. The amino acids have the following formula:

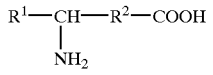

wherein $R^1$ is a hydrogen, a hydrocarbon of from 1 to about 22 carbon atoms (inclusive of alkyl, such as methyl, ethyl, propyl, and butyl), or a hydroxylated hydrocarbon of from 1 to about 22 carbon atoms; and $R^2$ is an alkylene group or hydroxylated alkylene of from zero to about 22 carbon atoms. Some examples of suitable amino acid complexing molecules include, but are not limited to, coco-beta-aminobutyric acid, tallow-beta-aminobutyric acid, coco-alpha-aminobutyric acid, coco-gamma-aminobutyric acid, coco-alpha-aminopropionic acid, coco-beta-aminopropionic acid, soya-beta-aminobutyric acid, octadecyl-beta-aminobutyric acid, hexadecyl-beta-aminobutyric acid, dodecyl-alpha-aminopropionic acid, and tetradecyl-alpha-amino-beta-hydroxy-butyric acid. N-coco-alkyl-3-aminobutanoic acid is the preferred complexing agent. Diisopropyl salicylate is an example of a non-amino acid chelate that is useful as a ligand in this invention. Obviously, many other ligands will be recognized by those of ordinary skill in this art as being useful in this invention. All of these are intended to be covered by the description of this invention.

The polyvalent metal compounds have the following formula:

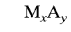

wherein M is a polyvalent cation, A is an anion, and x and y are integers from 1 to 4. Examples of polyvalent metal cations employed in the practice of this invention include, but are not limited to, aluminum, chromium, calcium, cobalt, magnesium, manganese, nickel, iron, zinc, titanium, and zirconium Examples of anions which serve as counterions in the resulting charge complex employed in the practice of this invention include, but are not limited to, chloride, bromide, iodide, chlorate, nitrate, sulfate, phosphate, and chromate. Examples of polyvalent metal compounds employed in the practice of this invention include, but are not limited to, aluminum chloride, aluminum nitrate, aluminum bromide, chromium chloride, chromium nitrate, chromium chlorate, magnesium chloride, magnesium nitrate, titanium chloride, and zirconium chloride. It will be obvious to those of ordinary skill in this art that some of the above recited combinations of metal ion and counterion may give rise to colored complexes. For the resulting metal-organic charge complex to be useful, it must be clear or colorless as stated above. If the starting polyvalent metal compound is colored, then it is useful in the practice of this invention only if it is clear or white after chelation with the organic ligand.

Other workers in this field have employed a chelate compound of ethylene diamine tetraacetic acid (EDTA) and a metal of di-, tri- or tetravalence to impart a positive charge on ink particles. Many of these chelates, however, are colored or unstable in aqueous medium.

Resins that contain either carboxylic or alcoholic components provide the necessary capabilities to react with a metal salt and thereby form a charge generator While a variety of molecules can serve as charge generators, aluminum diisopropyl salicylate functions particularly well. Without subscribing to a particular theory underling the formation of the charge complex, it is thought that the mechanism involves the relationship of the aluminum ion, which has a very small ionic radius, along with the active acid sites. The relationship allows solvation of the aluminum ion with the carboxyl group and the alcohol group which is highly favored and leads to a very stable charge complex. This complexation or chelation reaction causes some of the previous anions of the polyvalent inorganic compound to be replaced while others remain as counteranions to the metal-organic charge complex.

The charge complex can be used to modify inorganic pigments typically used in the manufacture of ink-jet papers. The pigments can be used separately or as mixtures Examples of pigments employed in the practice of this invention include, but are not limited to, calcium carbonate, kaolin clay, silica, titanium dioxide, satin white (an aluminum silicate), barytes (barium sulfate), mica, zinc oxide, and other inorganic pigments. While it is expected that any of the above-mentioned inorganic pigments would be useful in the practice of the invention, the preferred embodiments use either calcium carbonate or silica.

The weight percent of metal complex to inorganic pigment in the paper coating can vary from about 1 to 15 wt %, with the preferred concentration being about 5 wt %.

A binder is mixed with the inorganic pigment before it is applied to the paper. It is expected that any cationic or anionic binder will be useful in the practice of this invention. Examples of suitable binder polymers employed in the practice of this invention include, but are not limited to, hydrophilic polysaccharides and their modifications, such as starch (Pencote, available from Penford Product Co.), cationic starch, such as Cato-72 (available from National Starch), hydroxyalkylstarch (available from Union Carbide), gelatin, such as Calfskin gelatin #00639 (available from Polyscience Inc.), alkyl celluloses and aryl celluloses, (such as methyl cellulose, Methocel AM 4 (available from Dow Chemical Co.), hydroxyalkyl celluloses, such as Natrosol 250LR, and hydroxypropyl cellulose, such as Klucel (available from Hercules Chemical Co.). In the alkyl cellulose examples, the typical alkyl group has at least one carbon atom and the number of carbon atoms is such that the material is water-soluble; preferably, the alkyl group contains from 1 to 20 carbon atoms. Suitable alkyl groups employed in the practice of this invention include, but are not limited to, methyl, ethyl, propyl, butyl, pentyl, hexyl, and benzyl.

A preferred binder is a mixture of Pencote starch and hydroxypropyl cellulose. The ratio of Pencote starch to hydroxypropyl cellulose can range from 1:1 to 5:1 (by weight), with the preferred concentration being 2:1.

In the practice of the present invention, the coating that contains the pigment modified with the metal-organic charge complex is formulated in the following manner. The chosen amino acid is added to an isopropyl alcohol/water solution and a suitable inorganic pigment is added to the solution to form a slurry. A water-soluble salt containing the chosen metal ion is added. The resulting pigment is a mixture of the chosen inorganic pigment intimately mixed with the metal-organic charge complex. The metal organic charge complex has an associated counterion. The pigment is mixed with a binder as described above and finally deposited onto a print medium suitable both for such deposition and for ink-jet printing. Since paper typically already contains an inorganic pigment added during the manufacturing of the paper, the modified pigment described above can be conveniently added to the paper during the paper making process and thus provide an ink-jet paper containing the desired modification to the inorganic pigment.

The purity of all components discussed herein is that employed in normal commercial practice for paper making. All concentrations are expressed in weight percentages unless otherwise indicated. In addition to the modified inorganic pigment, the paper may contain components as normally found in commercial paper manufacture.

In the most preferred embodiment, the amino acid is N-coco-beta-amino butyric acid, the unmodified inorganic pigment is calcium carbonate, the inorganic salt is hydrated aluminum trichloride, and the binder is a mixture of Pencote (solution of 30% by weight of Pencote resin in water) starch and hydroxypropyl cellulose. The resulting modified pigment coating mixture is applied to the reverse side of a lightly sized, premium ink-jet paper with a metering Meyer rod and dried, such as with a heat gun, to obtain a dry coat weight at a loading of 8 grams per square meter.

It is contemplated that the performance of the color ink sets of Hewlett-Packard Company's DeskJet® 560C printer (all dye-based inks) and 850C, 1200C, 660C printers (pigment-based black ink; dye-based color inks), and a color pigment ink under development will all be improved when printed on the paper described herein. Furthermore, any printing ink in which the colorant has an opposite charge to the treated pigment contained in the print medium can be improved by this invention.

EXAMPLES

Example 1

A solution of Armeen Z, a commercially available source of N-coco-beta-amino-butyric acid solution (about 50 wt % solid acid), was prepared with 30 grams of Armeen Z in 200 grams of isopropyl alcohol and 200 grams of deionized water. 100 grams of Albaglos precipitated calcium carbonate was added to the above mixture while the mixture was stirred vigorously in a laboratory blender. The stirring continued for 30 minutes after the calcium carbonate was added to the mixture. 22.4 grams of aluminum trichloride was dissolved in 100 grams of deionized water. This solution was slowly added to the vigorously stirred calcium carbonate/ligand solution. After the addition of the aluminum solution, the mixture was continuously stirred for 30 additional minutes and the mixture's temperature was maintained at 66° C. The solution was allowed to cool to room temperature and was filtered. The resulting cake was washed with a 1:1 mixture of deionized water and isopropyl alcohol.

Sixty grams of the modified calcium carbonate (modified with the aluminum charge complex) was mixed with 100 grams of Pencote (30%) starch solution, giving a 2:1 pigment to binder ratio by weight. This pigment/starch mixture was applied to the back of a lightly sized ink-jet paper (such as Champion Duplicator) at 8 grams per square meter by means of a Meyer Rod and dried. The paper was printed with Hewlett-Packard Company's DeskJet® 850C and DeskJet® 560 ink-jet printers.

A control was prepared which contained non-treated calcium carbonate, Pencote starch solution, and water in the same ratio as described above for the treated calcium carbonate. Both the tested coating and the control coating were applied to the paper as described above.

The test described below measures the invasion of one ink into its neighboring ink area. For example, a blue line is printed inside in a small yellow box. The perimeter of the blue line is known before printing. After printing, the blue ink can migrate into its yellow neighbor. The line roughness and its perimeter measurement will increase. The result of the perimeter test is reported as the "delta perimeter" which is the actual line perimeter measurement minus the theoretical or intended line perimeter measurement reported in mils. The higher the delta value, the greater the extent of ink migration when printing with the tested ink. A lower delta value indicates a higher resolution and, therefore, inks demonstrating a lower delta value are preferred for ink-jet printing. The line perimeters are measured with a high precision visual microscope system. In Tables I and II, blue/yellow refers to a test in which a blue line is printed within a yellow solid fill area, while blue/red refers to a test in which a blue line is printed within a red solid fill area, and so on.

TABLE I

Line Roughness Comparison of Treated Pigment vs. Control-Printed on DeskJet ® 850C Ink-Jet Printer at Ambient Temperature

| | Delta Perimeter for Treated Pigment | Delta Perimeter for Control |
|---|---|---|
| blue/yellow | 104 | 167 |
| blue/red | 345 | 673 |
| white/blue | 87 | 79 |
| red/yellow | 95 | 118 |
| black/cyan | 36 | 55 |
| black/yellow | 76 | 57 |

TABLE II

Line Roughness Comparison of Treated Pigment vs. Control-Printed on a DeskJet ® 1200C Ink-Jet Printer at Ambient Temperature

| | Delta Perimeter for Treated Pigment | Delta Perimeter for Control |
|---|---|---|
| blue/yellow | 116 | 224 |
| blue/red | 125 | 386 |
| white/blue | 68 | 297 |
| red/yellow | 102 | 234 |
| black/cyan | 52 | 172 |
| black/yellow | 89 | 149 |

It is seen from Tables I and II that, in almost all instances, employing the coated paper of the invention resulted in less migration of one ink into the other.

Example 2

To evaluate the ability of the organo-aluminum charge complex to precipitate the ink-jet inks, the following experiment was performed. 100 grams of deionized water, 100 grams of isopropyl alcohol, 30 grams of Armeen Z, and 22.4 grams of aluminum trichloride 6-hydrate were combined in a beaker with stirring. The solution was heated to 80° C. for thirty minutes. The mixture was cooled to room temperature, after which the aluminum charge complex precipitated. The precipitate was filtered and washed with deionized water. The precipitate was slurried with a one-to-one mixture of deionized water and isopropyl alcohol. This solution was filtered and the filtrate, which contained dissolved aluminum charge complex, was used in testing the inks.

The following procedure was used to test the inks: a test tube was filled with a solution of aluminum charge complex, two to three drops of the desired ink were placed in the solution, and the solution was visually monitored for precipitation of the dyes. The following inks were tested: inks of DeskJet® 1200C printer (1200C), inks of DeskJet® 560C printer (560C), DeskJet® 850C printer (850C), pigment-based black ink of DeskJet® 660C printer (660C-pigment), dye-based color inks of DeskJet® 660C printer (660C-dye) and a color pigment ink under development (color pigment).

TABLE III

Precipitation Test of Inks

| Ink Family (Printer) | Ink Colors: Black | Cyan | Magenta | Yellow |
|---|---|---|---|---|
| 560C | ppt | ppt | no ppt | ppt |
| 1200C | ppt | no ppt | ppt | ppt |
| 850C | ppt | ppt | ppt | ppt |
| 660C-pigment | ppt | N/A | N/A | N/A |
| 660C-dye | N/A | ppt | ppt | ppt |
| color pigment | ppt | ppt | no ppt | ppt |

Notes:
ppt = precipitate
N/A = not applicable

The main function of the charge complex in the modified inorganic pigment is to cause precipitation of the anionic dye components of the various inks to improve color retention and saturation, image quality, image density, image bleed and water sensitivity while alleviating print defects caused by excessive penetration of the ink into the paper. As the above example illustrates, the chosen aluminum charge complex causes the desired precipitation in substantially all the inks of the various ink sets tested above.

Example 3

This example demonstrates that the aluminum charge complex modifies the electrostatic behavior of the inorganic pigment. Inorganic pigment, modified by the addition of aluminum charge complex, was dispersed in kerosene to about 1% solid concentration and tested in a constant direct current electric field. The cell was approximately 4 cm×4 cm×1 cm. It consisted of two stainless steel electrodes held 1 cm apart. The cell was filled with the above kerosene and pigment suspension. A constant direct current voltage of 1000V was applied for 1 minute. Treated calcium carbonate was deposited, as expected, on the negative electrode during the experiment. When a similar experiment was undertaken with untreated calcium carbonate pigment, no deposit formed. The disparity of results between the treated and untreated calcium carbonate inorganic pigments demonstrates that, after treatment with the charged complex, the inorganic pigment acquires a positive charge relative to the untreated pigment. Therefore, the aluminum charge complex can successfully be incorporated into the inorganic pigment and cause its electrostatic behavior to change. Furthermore, X-ray spectra (backscatter from SCM) of treated calcium carbonate and untreated calcium carbonate pigment show the presence of aluminum in the treated pigment and the absence of aluminum in the untreated pigment.

INDUSTRIAL APPLICABILITY

The application of a coating that contains an inorganic pigment, modified with a positively charged complex, and a binder to a print medium is expected to find commercial use in thermal ink-jet color printers.

Thus, there has been disclosed a coating for ink-jet paper that contains an inorganic pigment, modified with a positively charged metal-organic complex, and a binder. It will be readily apparent to those skilled in the art that various changes and modifications of an obvious nature may be made without departing from the spirit of the invention, all such changes and modifications are considered to fall within the scope of the invention as defined by the appended claims.

What is claimed is:

1. An ink-jet paper which improves resolution, color retention, waterfastness, smear-fastness, image retention and image density while decreasing image bleed of the printer output in ink-jet printing, comprising a base paper and a coating thereon, wherein said coating contains an inorganic pigment modified with a positively charged complex and a binder, wherein said positively charged complex contains a polyvalent metal ion and an organic ligand.

2. The ink-jet paper of claim 1 wherein said binder is selected from the group consisting of gelatin, ionic starch, nonionic starch, alkyl celluloses, aryl celluloses, hydroxyalkyl celluloses, and mixtures thereof; wherein said alkyl celluloses contain an alkyl group, wherein said alkyl group has between 1 and 20 carbon atoms; and wherein said binder is water-soluble.

3. The ink-jet paper of claim 2 wherein said binder is selected from the group consisting of hydroxyethyl cellulose, hydroxypropyl cellulose, methyl cellulose, ethyl cellulose, propyl cellulose, butyl cellulose, pentyl cellulose, hexyl cellulose, benzyl cellulose, and mixtures thereof.

4. The ink-jet paper of claim 1 wherein said inorganic pigment is selected from the group of pigments consisting of calcium carbonate, kaolin clay, silica, titanium dioxide, aluminum silicates, barytes, mica, zinc oxide, and mixtures thereof.

5. The ink-jet paper of claim 1 wherein said metal ion is selected from the group consisting of Al, Cr, Ca, Co, Mg, Mn, Ni, Fe, Zn, Ti, and Zr, and wherein said organic ligand is selected from the group consisting of diisopropyl salicylate, coco-beta-aminobutyric acid, tallow-beta-aminobutyric acid, coco-alpha-aminobutyric acid, coco-gamma-aminobutyric acid, coco-alpha-aminopropionic acid, coco-beta-amino-propionic acid, soya-beta-aminobutyric acid, octadecyl-beta-aminobutyric acid, hexadecyl-beta-aminobutyric acid, dodecyl-alpha-aminopropionic acid, and tetradecyl-alpha-amino-beta-hydroxy-butyric acid.

6. The ink-jet paper of claim 1 wherein:

(a) said binder is selected from the group consisting of gelatin, ionic starch, nonionic starch, alkyl celluloses, aryl celluloses, hydroxyalkyl celluloses, and mixtures thereof; wherein said alkyl celluloses contain an alkyl group, wherein said alkyl group has between 1 and 20 carbon atoms; and said binder is water soluble;

(b) said inorganic pigment is selected from the group of pigments consisting of calcium carbonate, kaolin clay, silica, titanium dioxide, aluminum silicates, barytes, mica, zinc oxide, and mixtures thereof;

(c) said inorganic pigment, modified with a positively charged complex comprises a mixture of inorganic pigment and positively charged complex wherein said positively charged complex has a concentration of about 1 to 15 wt %;

(d) said positively charged complex comprises a metal ion and an organic ligand wherein said metal ion is selected from the group consisting of Al, Cr, Ca, Co, Mg, Mn, Ni, Fe, Zn, Ti, and Zr, and wherein said organic ligand is selected from the group consisting of diisopropyl salicylate, coco-beta-aminobutyric acid, tallow-beta-aminobutyric acid, coco-alpha-aminobutyric acid, coco-gamma-aminobutyric acid, coco-alpha-aminopropionic acid, coco-beta-amino-propionic acid, soya-beta-aminobutyric acid, octadecyl-beta-aminobutyric acid, hexadecyl-beta-aminobutyric acid, dodecyl-alpha-aminopropionic acid, and tetradecyl-alpha-amino-beta-hydroxy-butyric acid.

7. The ink-jet paper of claim 6 wherein said inorganic pigment is selected from the group consisting of silica, calcium carbonate, and a mixture thereof; wherein said positively charged complex consists of Al, N-coco-alkyl-3-aminobutanoic acid, and a chloride ion; and wherein said binder consists of a mixture of hydroxypropyl cellulose and anionic starch.

8. The ink-jet paper of claim 1 wherein said polyvalent metal cation is associated with an anion.

9. The ink-jet paper of claim 8 wherein said anion is selected from the group consisting of chloride, bromide, iodide, chlorate, nitrate, sulfate, phosphate, and chromate.

10. An ink-jet paper which improves resolution, color retention, waterfastness, smear-fastness, image retention and image density while decreasing image bleed of the printer output in ink-jet printing, comprising a base paper and a coating thereon, wherein said coating contains an inorganic pigment modified with a positively charged complex and a binder, wherein:

(a) said binder is selected from the group consisting of gelatin, ionic starch, nonionic starch, alkyl celluloses, aryl celluloses, hydroxyalkyl celluloses, and mixtures thereof; wherein said alkyl celluloses contain an alkyl group, wherein said alkyl group has between 1 and 20 carbon atoms; and said binder is water soluble;

(b) said inorganic pigment is selected from the group of pigments consisting of calcium carbonate, kaolin clay, silica, titanium dioxide, aluminum silicates, barytes, mica, zinc oxide, and mixtures thereof;

(c) said inorganic pigment, modified with a positively charged complex, comprises a mixture of inorganic pigment and positively charged complex wherein said positively charged complex has a concentration of about 1 to 15 wt %; and (d) said positively charged complex comprises a metal ion and an organic ligand wherein said metal ion is selected from the group consisting of Al, Cr, Ca, Co, Mg, Mn, Ni, Fe, Zn, Ti, and Zr, and wherein said organic ligand is selected from the group consisting of diisopropyl salicylate, coco-beta-aminobutyric acid, tallow-beta-aminobutyric acid, coco-alpha-aminobutyric acid, coco-gamma-aminobutyric acid, coco-alpha-aminopropionic acid, coco-beta-amino-propionic acid, soya-beta-aminobutyric acid, octadecyl-beta-aminobutyric acid, hexadecyl-beta-aminobutyric acid, dodecyl-alpha-aminopropionic acid, and tetradecyl-alpha-amino-beta-hydroxy-butyric acid.

11. The ink-jet paper of claim 10 wherein said binder is selected from the group consisting of hydroxyethyl cellulose, hydroxypropyl cellulose, methyl cellulose, ethyl cellulose, propyl cellulose, butyl cellulose, pentyl cellulose, hexyl cellulose, benzyl cellulose, and mixtures thereof.

12. The ink-jet paper of claim 10 wherein said polyvalent metal cation is associated with an anion.

13. The ink-jet paper of claim 12 wherein said anion is selected from the group consisting of chloride, bromide, iodide, chlorate, nitrate, sulfate, phosphate, and chromate.

14. The ink-jet paper of claim 10 wherein said inorganic pigment is selected from the group consisting of silica, calcium carbonate, and a mixture thereof wherein said positively charged complex consists of Al, N-coco-alkyl-3-aminobutanoic acid, and a chloride ion; and wherein said binder consists of a mixture of hydroxypropyl cellulose and anionic starch.

* * * * *